US010604881B1

(12) United States Patent
Allen et al.

(10) Patent No.: US 10,604,881 B1
(45) Date of Patent: Mar. 31, 2020

(54) CONSOLE SHELL FOR A LAUNDRY APPLIANCE

(71) Applicant: WHIRLPOOL CORPORATION, Benton Harbor, MI (US)

(72) Inventors: Ryan L. Allen, Kalamazoo, MI (US); Charles J. Guidarini, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/275,783

(22) Filed: Feb. 14, 2019

(51) Int. Cl.
*D06F 39/00* (2020.01)
*E05F 5/02* (2006.01)
*D06F 39/12* (2006.01)

(52) U.S. Cl.
CPC ..... *D06F 39/005* (2013.01); *D06F 39/12* (2013.01); *E05F 5/02* (2013.01); *E05Y 2900/312* (2013.01)

(58) Field of Classification Search
CPC ... D06F 39/12; D06F 9/14; E05F 5/02; E05Y 2900/312
See application file for complete search history.

(56) References Cited

U.S. PATENT DOCUMENTS 6,665,984 B2 12/2003 Bienick et al.
8,444,234 B2 * 5/2013 Kim ..... D06F 23/04 134/200
9,315,934 B2 4/2016 Kim et al.
9,316,440 B2 4/2016 Kim et al.
9,598,811 B2 3/2017 Lee et al.
2006/0090523 A1 * 5/2006 Lyu ..... D06F 77/28 68/3 R
2011/0062837 A1 * 3/2011 Kim ..... D06F 23/04 312/228
2011/0121694 A1 * 5/2011 Kim ..... D06F 39/14 312/204
2014/0125210 A1 * 5/2014 Park ..... D06F 39/14 312/319.1
2015/0008808 A1 * 1/2015 Kim ..... D06F 39/14 312/228
2016/0194814 A1 * 7/2016 Kim ..... D06F 39/005 34/108
2017/0130502 A1 * 5/2017 Collene ..... E05F 3/20
2017/0159229 A1 * 6/2017 Park ..... D06F 39/14
2018/0266156 A1 * 9/2018 Mora ..... E05F 3/16
2019/0249349 A1 * 8/2019 Han ..... D06F 37/28

FOREIGN PATENT DOCUMENTS

EP 2495363 A1 9/2012

* cited by examiner

*Primary Examiner* — Daniel J Rohrhoff
(74) *Attorney, Agent, or Firm* — Price Heneveld LLP

(57) ABSTRACT

A laundry appliance includes a cabinet and a top panel coupled to a top edge of the cabinet. A console shell is coupled to the top panel. The console shell defined left and right shoulders extending from the console shell towards a front of the cabinet. An edge-to-edge lid is coupled to the left and right shoulders via left and right wire hinges, respectively.

19 Claims, 5 Drawing Sheets

CONSOLE SHELL FOR A LAUNDRY APPLIANCE

FIELD OF DISCLOSURE

The present disclosure relates to console shells, and more specifically, to console shells for a laundry appliance having first and second shoulders.

BACKGROUND

Consoles may be used for coupling lids or doors to laundry appliances. Edge-to-edge doors typically require specific and costly attachment members to couple the door to the console.

SUMMARY

In at least one aspect, a laundry appliance includes a cabinet and a top panel coupled to a top edge of the cabinet. A console shell is coupled to the top panel. The console shell defined left and right shoulders extending from the console shell towards a front of the cabinet. An edge-to-edge lid is coupled to the left and right shoulders via left and right wire hinges, respectively.

In at least another aspect, a laundry appliance includes a cabinet and a top panel coupled to a top edge of the cabinet. A console shell is coupled to the top panel. The console shell defines left and right shoulders. An edge-to-edge lid is coupled to the left and right shoulders via left and right rotary dampers, respectively.

In at least another aspect, a laundry appliance includes a cabinet. A console shell is coupled to the cabinet. The console shell defines first and second shoulders. An edge-to-edge lid is pivotally coupled to the first and second shoulders.

These and other features, advantages, and objects of the present device will be further understood and appreciated by those skilled in the art upon studying the following specification, claims, and appended drawings.

DETAILED DESCRIPTION OF EMBODIMENTS

Figure 1:
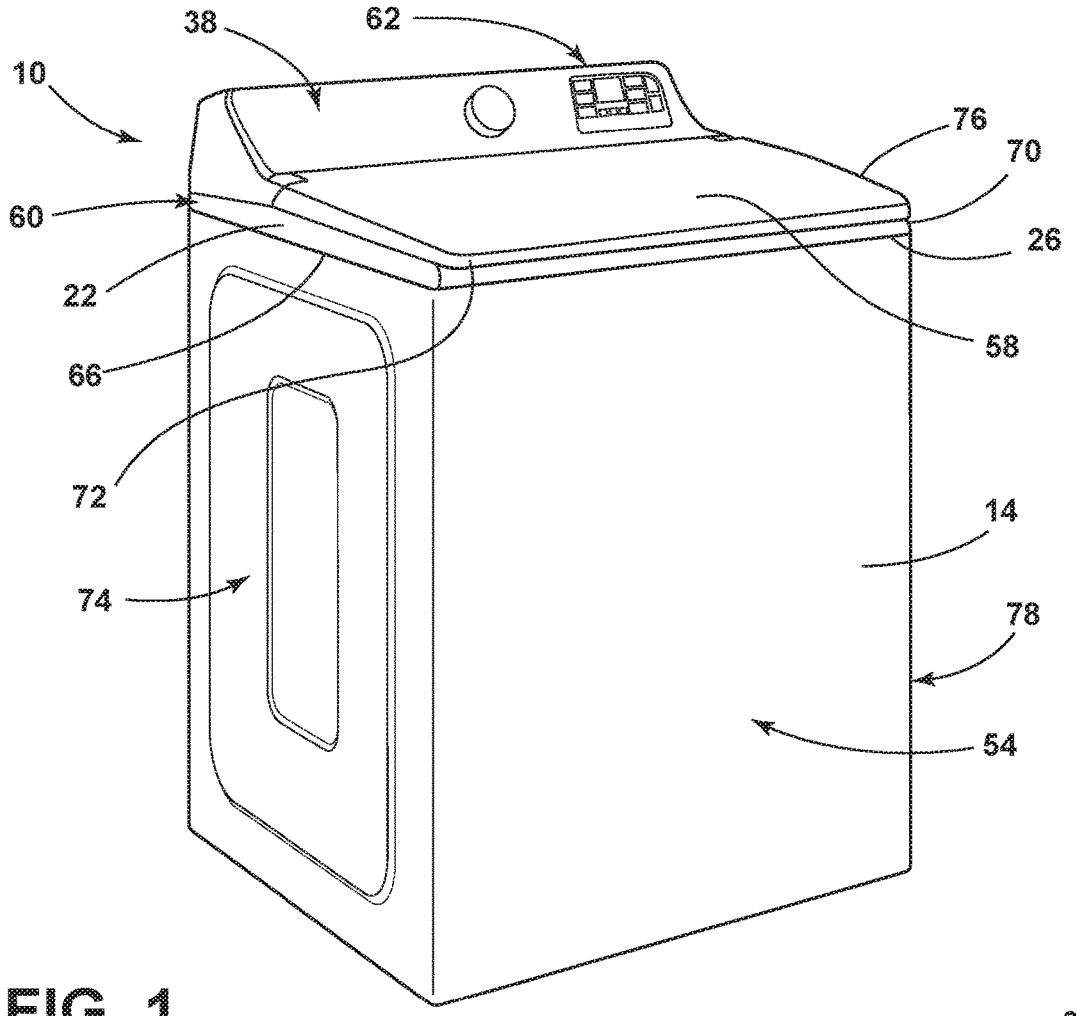
FIG. 1 is a side perspective view of a laundry appliance having an edge-to-edge lid, according to at least one example.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the terms "about" and "approximately" mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the terms "about" and "approximately" are used in describing a value or an end-point of a range, the disclosure should be understood to include the specific value or end-point referred to. Whether or not a numerical value or end-point of a range in the specification recites "about" or approximately," the numerical value or end-point of a range is intended to include two embodiments: one modified by "about" or "approximately," and one not modified by "about" or "approximately." It will be further understood that the end-points of each of the ranges are significant both in relation to the other end-point, and independently of the other end-point.

With reference to FIG. 1-9, reference numeral 10 generally refers to a laundry appliance.

The laundry appliance 10 includes a cabinet 14 defining an interior cavity 18 therein. A top panel 22 may be coupled to a top edge portion 26 of the cabinet 14 and 10 define an opening 30 accessing the interior cavity 18. The laundry appliance 10 may include a console shell 38 having a body 42 and a first left shoulder 82 and a second right shoulder 86 extending from the body 42 towards a front 54 of the cabinet 14. The laundry appliance 10 may also include an edge-to-edge lid 58 be coupled to the console shell 38 and operable between opened and closed positions with respect to the opening 30.

Figure 6:
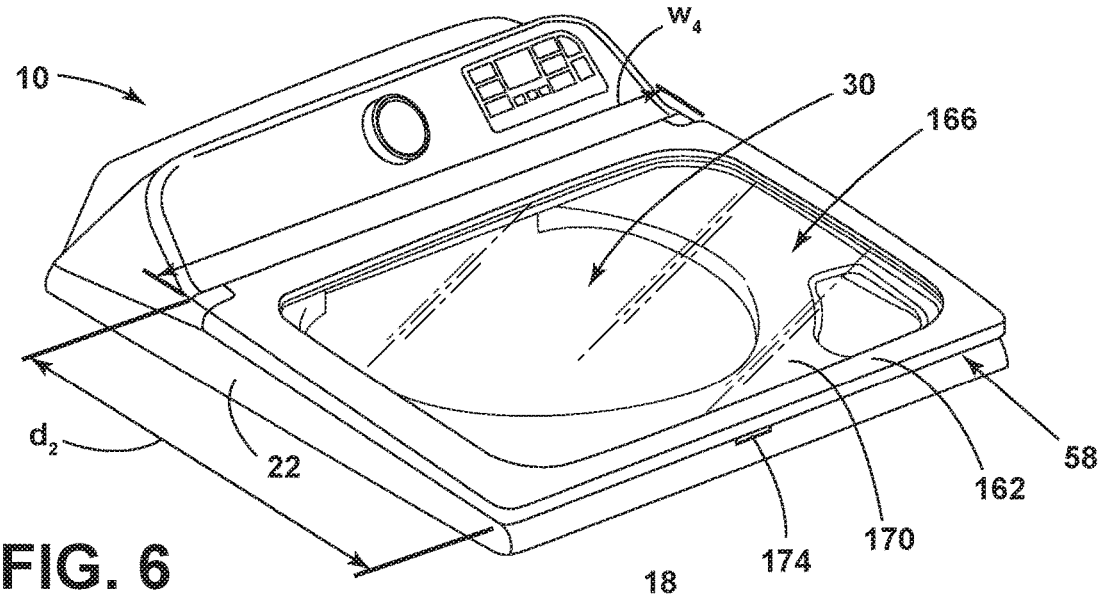
FIG. 6 is a top perspective view of the top panel of the laundry appliance where the edge-to-edge lid includes a frame and an inner panel, according to at least one example.

Referring to FIGS. 1 and 6, the laundry appliance 10 is shown as a vertical-axis washer, but may be another type of washer, dryer, or combination laundry appliance. The laundry appliance 10 may include the cabinet 14 and the top panel 22. As shown in FIG. 1, the top panel 22 can be coupled to the top edge portion 26 of the cabinet 14. The top panel 22 may define the opening 30 for accessing the interior cavity 18 of the laundry appliance 10. In various examples, the console shell 38 may be coupled to the top panel 22. In such examples, the console shell 38 may be coupled to a back edge portion 60 of the top panel 22.

The console shell 38 may be coupled to the cabinet 14 directly without the inclusion of the top panel 22 therebetween. In such examples, the cabinet 14 can define the opening 30 to access the interior cavity 18 of the laundry appliance 10. It will be contemplated that the console shell 38 may be located in various locations based on the model and/or type of laundry appliance 10. The console shell 38 may include a user-interface 62 to operate the laundry appliance 10. The user-interface 62 can include, for example, buttons, knobs, and/or dials for a user to control the laundry appliance. Also, the user-interface 62 may include a touch screen for operating the laundry appliance 10. Additionally, the console shell 38 may define the left and right shoulders 82, 86 that extend from the console shell 38 towards the front 54 of the cabinet 14.

Referring still to FIG. 1, the edge-to-edge lid 58 may be coupled to the left and right shoulders 82, 86. The edge-to-edge lid 58 may extend from a left edge 66 of the top panel 22 to a right edge 70 of the top panel 22 and/or cabinet 14. In other words, left and right outer edges 72, 76 of the edge-to-edge lid 58 correspond with the left and right edges 66, 70 of the top panel 22. This configuration between the edge-to-edge lid 58 and the top panel 22 may improve the aesthetics of the laundry appliance 10.

Figure 2:
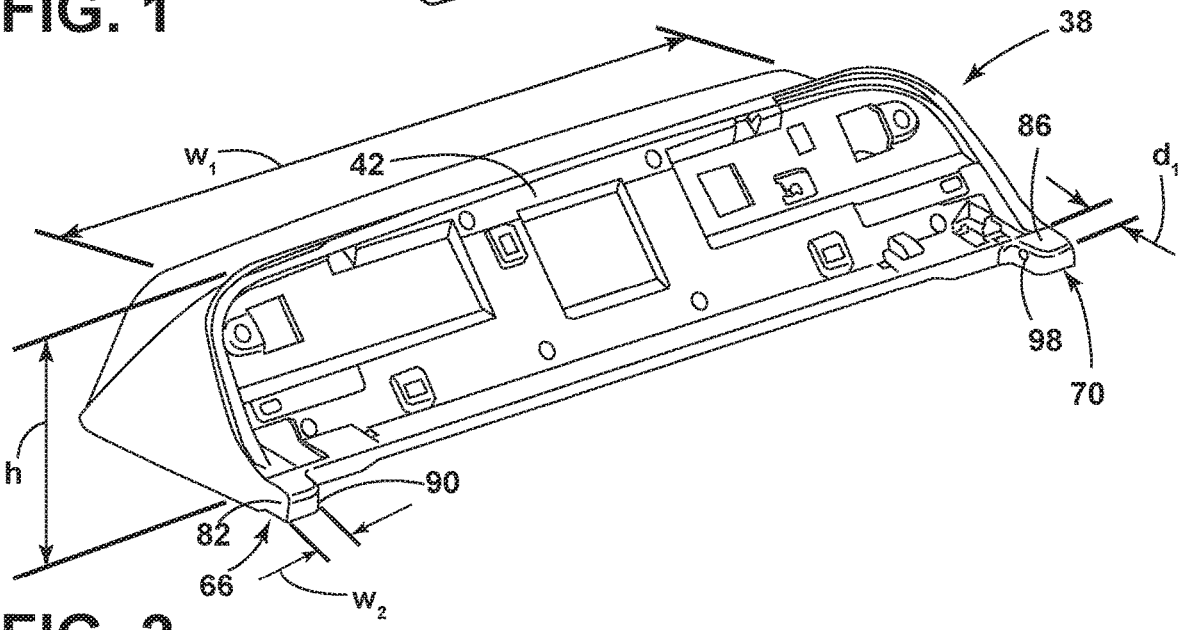
FIG. 2 is a partial view of a console shell of a laundry appliance that defines left and right shoulders, according to at least one example.

Referring to FIGS. 1 and 2, the console shell 38 may include the body 42 and first and second shoulder enclosures 46, 50 extending from the body 42. The first and second shoulder enclosures 46, 50 typically correspond to left and right sides 74, 78 of the laundry appliance 10 such that the first shoulder enclosure 46 includes the left shoulder 82 and the second shoulder enclosure 50 includes the right shoulder 86. However, the right and left shoulders 82, 86 may also be front and back shoulders or top and bottom shoulders based on the model and/or type of laundry appliance. For example, horizontal-axis washers include a door coupled to a front of the washer and therefore the shoulders would be aligned vertically as top and bottom shoulders.

Referring still to FIGS. 1 and 2, the console shell 38 may define the left and right shoulders 82, 86, which can extend from the console shell 38 towards an opposing edge of the laundry appliance 10, typically the front 54 of the cabinet 14 of the laundry appliance 10. In various examples, the console shell 38 includes the body 42 positioned between the left and right shoulders 82, 86. The left and right shoulders 82, 86 may extend from the body 42 of the console shell 38. The console shell 38 may include the body 42 and left and right shoulders 82, 86 that form a single integral piece. In such examples, the console shell 38 can be made via, for example, various molding or stamping techniques. The left and right shoulders 82, 86 may be integrally formed with the remainder of the console shell 38. Accordingly, the console shell 38 and the left and right shoulders 82, 86 may be formed from, for example, plastics, metals, or other rigid materials. It may be advantageous to have the body 42 and the left and right shoulders 82, 86 of the console shell 38 be a single integral piece to reduce manufacturing and production costs. Further, as a non-limiting example, the console shell 38 may have a width $w_1$ in a range of from approximately 550 mm to approximately 750 mm, thereby extending from the left edge 66 to the right edge 70 of the top panel 22. The console shell 38 may have a height h in a range of from approximately 150 mm to 350 mm. It will be contemplated that the width $w_1$ and the height h may differ based on the size and/or model of the laundry appliance 10. Additionally, the left and right shoulders 82, 86 may each have a width $w_2$ in a range of from approximately 20 mm to approximately 60 mm. A depth $d_1$ of the left and right shoulders 82, 86 may be in a range of from approximately 15 mm to approximately 50 mm. The positioning and dimensions of the left and right shoulders 82, 86 can provide for a continuous planar surface when the edge-to-edge lid 58 is in the closed position.

In various examples, the left and right shoulders 82, 86 may extend a distance in a range of from approximately 1 inch to approximately 2 inches from the console shell 38. The left and right shoulders 82, 86 may extend approximately 1 inch from the body 42 of the console shell 38. The left and right shoulder 82, 86 may extend approximately 2 inches from the body 42 the console shell 38. The left and right shoulders 82, 86 may have a rounded interior edge 90 configured to hingedly or pivotally cooperate with the edge-to-edge lid 58. In various examples, the left and right shoulders 82, 86 may each define an aperture 94 on an interior surface 98 for receiving the wire hinges 102 (FIG. 3) and pivotally coupling the edge-to-edge lid 58 the left and right shoulders 82, 86.

Figure 3:
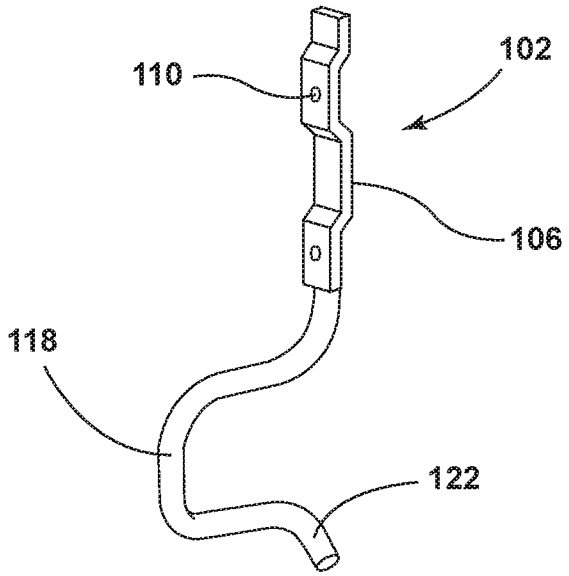
FIG. 3 is a front perspective view of a wire hinge for coupling the edge-to-edge lid to the left and right shoulders, according to at least one example.
Figure 4:
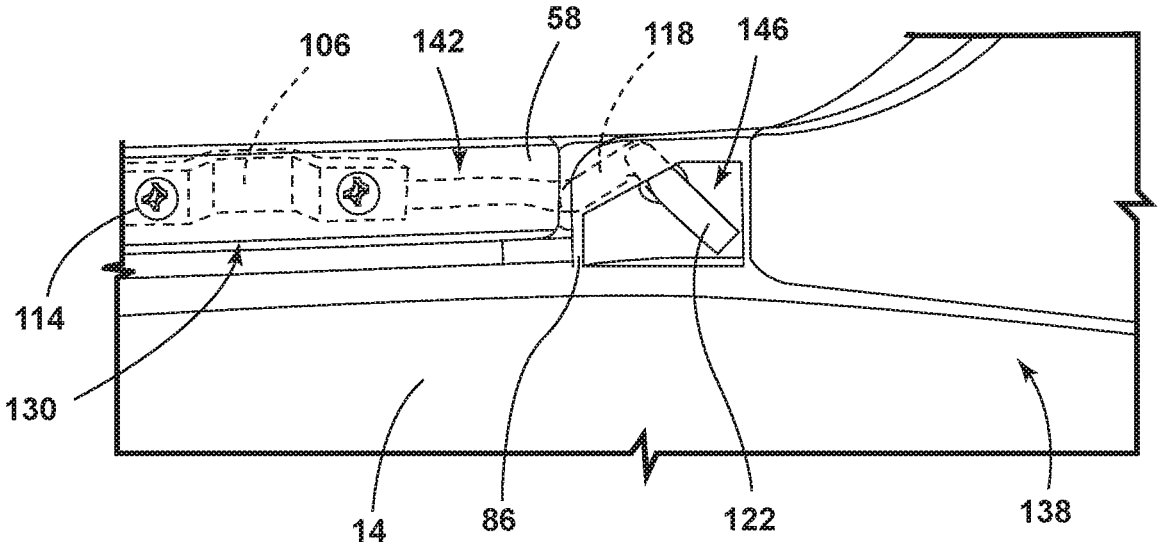
FIG. 4 is a partial side view of the right shoulder with the edge-to-edge lid in a closed position, according to at least one example.
Figure 5:
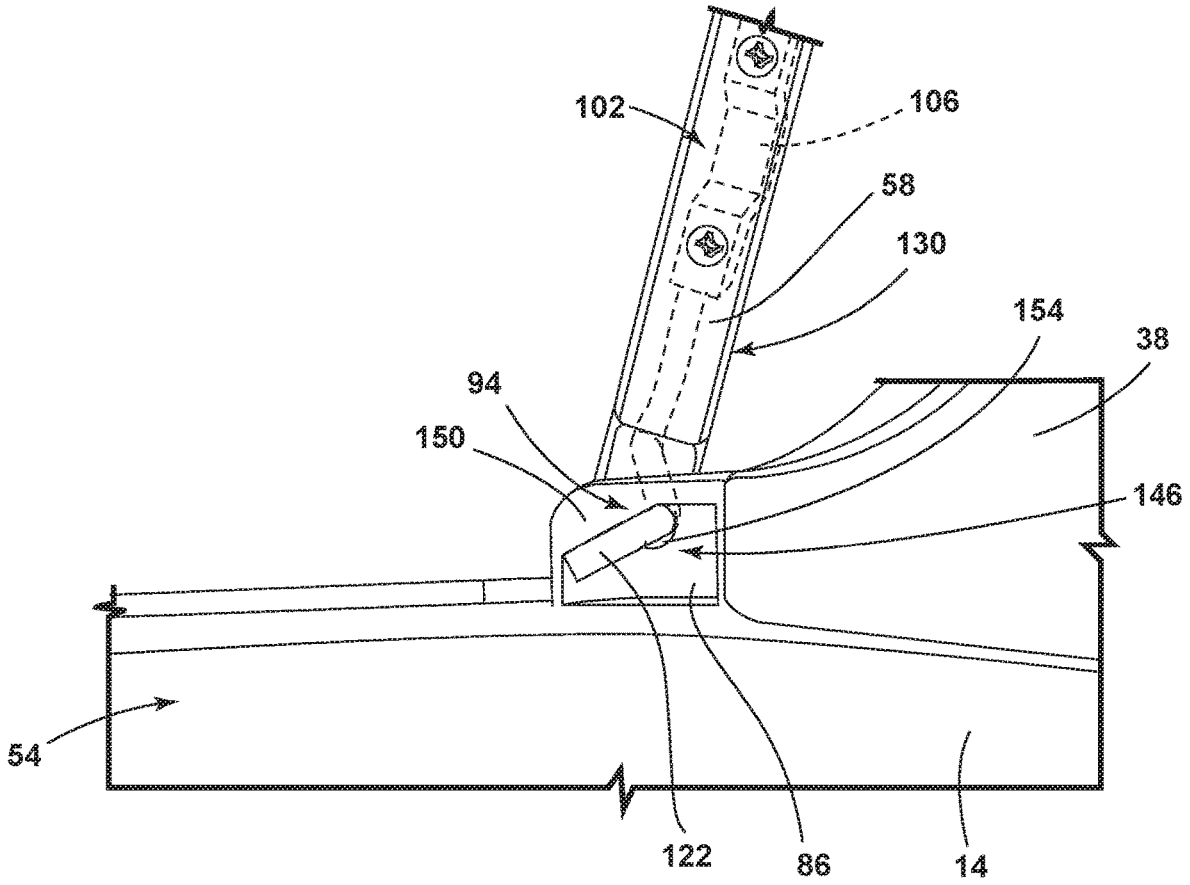
FIG. 5 is a partial side view of the right shoulder with the edge-to-edge lid in an opened position, according to at least one example.

Referring now to FIGS. 3-5, the edge-to-edge lid 58 may be pivotally coupled to the left and right shoulders 82, 86 via wire hinges 102. In other words, the edge-to-edge lid 58 may be coupled to the left and right shoulders 82, 86 via left and right wire hinges 102, respectively. As shown in FIG. 3, the wire hinge 102 may include a substantially linear portion 106 defining at least one hole 110 configured to receive a coupling member 114 of the edge-to-edge lid 58. The substantially linear portion 106 can be coupled to a U-shaped portion 118 and the U-shaped portion 118 may be coupled to a hook 122 of the wire hinge 102. In various examples, the hook 122 and the substantially linear portion 106 may be aligned with the U-shaped portion 118 extending substantially perpendicular therebetween.

Referring to FIGS. 3-4, the substantially linear portion 106 of the wire hinge 102 may extend it to outer edge portion 130 of the edge-to-edge lid 58. The holes 110 of the wire hinge 102 can receive the coupling member 114 to couple the wire hinge 102 to an interior 142 of the edge-to-edge lid 58. The coupling member 114 may be, for example, a screw, a pin, or a bolt. As depicted in FIG. 4, the U-shaped portion 118 may extend further into the interior 142 of the edge-to-edge lid 58, towards a back 138 of the cabinet 14, and then into the right shoulder 86 via the aperture 94. The hook portion 122 of the wire hinge 102 curves towards the back 138 of the cabinet 14 within a cavity 146 defined by the right shoulder 86 to secure the edge-to-edge lid 58 to the right shoulder 86. It will be understood that the wire hinge 102 coupled to the left shoulder 82 (FIG. 2) in a substantially similar manner.

As shown in FIG. 4, the edge-to-edge lid 58 is in the closed position and coupled to the right shoulder 86. When in the closed position, the hook 122 of the wire hinge 102 extends towards the back 138 of the cabinet 14. When the edge-to-edge lid 58 is in the opened position, as shown in FIG. 5, the hook 122 extends towards the front 54 of the cabinet 14. The left and right shoulders 82, 86 each include a hinge stop 150. The hinge stops 150 may be integrally formed with the left and right shoulder 82, 86, respectively, or may be a separate piece. In various examples, the hinge stops 150 may be an oblique interior surface that extends into the cavity 146 of the left and right shoulders 82, 86, respectively, and may be configured to cooperate with the hook 122 of the wire hinge 102. In other words, the left and right wire hinges 102 may include the hook 122, which may be configured to cooperate with the left and right hinge stops 150, respectively, to define an open position of the edge-to-edge lid 58. The hinge stops 150 may also prevent the edge-to-edge lid 58 from opening past a desired opened position and/or prevent damage to the console shell 38 or user-interface 62 (FIG. 1).

The left and right shoulders 82, 86 may include bearings 154 positioned about the apertures 94, respectively. These bearings 154 promote the rotation of the U-shaped portion 118 within the aperture 94. The bearings 154 can be in the form of a rotational bearing assembly or other sliding assembly that promotes the smooth operation of the edge-to-edge lid 58. The bearings 154 may reduce wear on the apertures 94 and/or left and right shoulders 82, 86 caused by the edge-to-edge lid moving between the opened and closed positions. In various examples, the edge-to-edge lid 58 maybe made from, for example, metals or metal alloys, such as steel. Use of the wire hinges 102 with the left and right shoulders 82, 86 may be advantageous for utilization of a steel edge-to-edge lid 58 for decreasing manufacturing and/or production costs.

In operation, the wire hinges 102 may rotate about the apertures 94 as the edge-to-edge lid 58 moves between the opened and closed positions. The wire hinges 102 may move from a substantially horizontal position when the edge-to-edge lid 58 is in the closed position to a substantially vertical position when the edge-to-edge lid 58 is in the opened position. The hooks 122 may rotate within the cavity 146 of the left and right shoulders 82, 86, respectively, and stop when the hooks 122 abut the hinge stops 150, thereby defining the opened position of the edge-to-edge lid 58.

Referring now to FIG. 6, the edge-to-edge lid 58 may include a frame 162 positioned about an inner panel 166. In various examples, the edge-to-edge lid 58 may include a glass panel 170 positioned within the frame 162. Use of the glass panel 170 may be advantageous to improve the aesthetics of the laundry appliance. The glass panel 170 and/or inner panel 166 may be substantially translucent, substantially opaque, or a visibility therebetween. In various examples, the laundry appliance 10 may include a detent lock 174 coupled to the edge-to-edge lid and the cabinet 14 (FIG. 1) and/or the top panel 22. The detent lock 174 may allow the edge-to-edge lid 58 to securely lock into the closed position.

Figure 7:
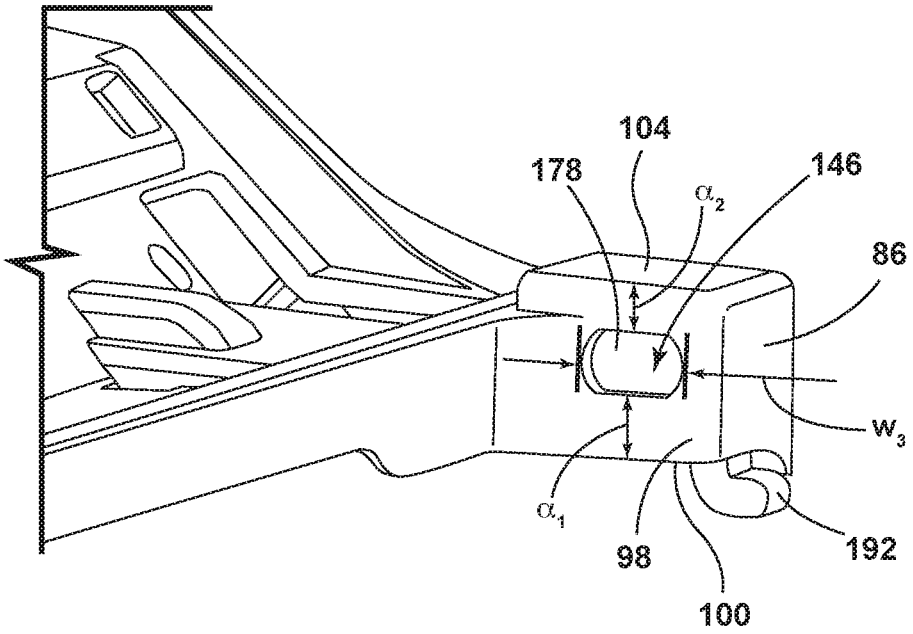
FIG. 7 is a partial side view of the left shoulder defining a slot, according to at least one example.

Referring to FIG. 7, the left and right shoulders 82, 86 may each include an L-shaped protrusion 192 extending from lower surfaces 100 of the left and right shoulders 82, 86 respectively. The L-shaped protrusion 192 may be advantageous in coupling the console shell 38 to the top panel 22. It will be contemplated that the L-shaped protrusion 192 may also extend from an alternate location on the console shell 38.

Figure 8:
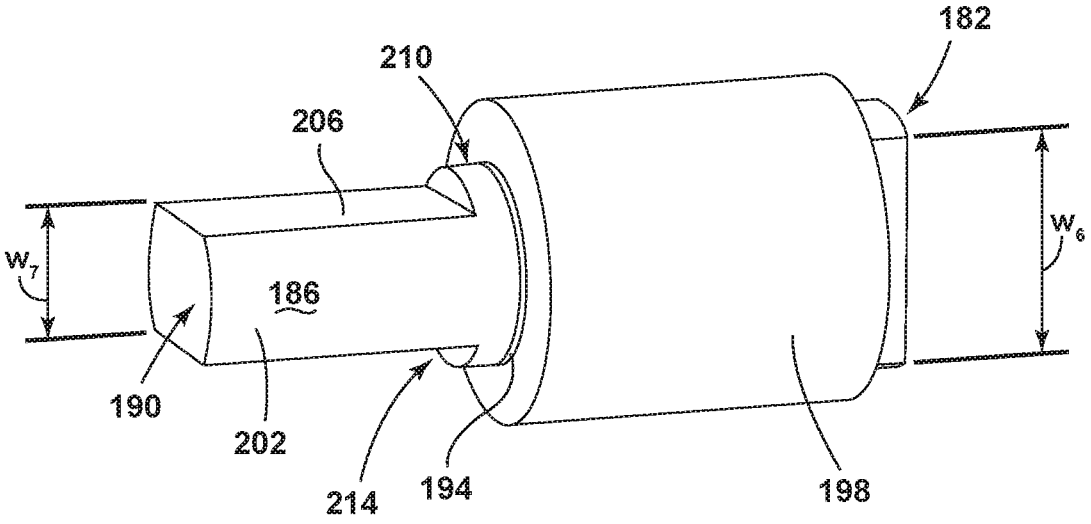
FIG. 8 is a side perspective view of a rotary damper for coupling the edge-to-edge lid to the console shell, according to at least one example.

Referring to FIGS. 7 and 8, the right shoulder 86 is shown defining a slot 178 on the interior surface 98. The slot 178 may be substantially similar to the aperture 94 (FIG. 2) or may have a more oblong shape compared to the aperture 94. The slot 178 may be configured to receive a rotary damper 182. The slot 178 may be sized to securely fit about an outer surface 186 of a shaft 190 of the rotary damper 182 to securely couple the rotary damper 182 to the right shoulder 86. Additionally, the right shoulder 86 includes the cavity 146 to receive the shaft 190 of the rotary damper 182. It will be understood that the rotary damper 182 may couple to the left shoulder 82 (FIG. 2) in a similar manner. In other words, the left and right shoulders 82, 86 each define cavities 146 for securing the shafts 190 of the left and right rotary dampers 182, respectively. The rotary damper 182 may include an integral bearing 154.

Referring to FIGS. 2 and 7, as a non-limiting exemplary aspect, the apertures 94 and/or the slots 178 may have a width $w_3$ in a range of from approximately 4 mm to approximately 15 mm. The apertures 94 and/or the slots 178 may be spaced apart from the lower surfaces 100 of the left and right shoulders 82, 86. A distance $\alpha_i$ between the lower surface 100 and the aperture 94 and/or the slot 178 may be in a range of from approximately 5 mm to approximately 20 mm. The apertures 94 and/or the slots 178 may also be spaced apart from upper surfaces 104 of the left and right shoulders 82, 86, respectively. A distance $\alpha_2$ between the aperture 94 and/or the slot 178 may be in a range of from approximately 5 mm to approximately 20 mm. It will be contemplated that the width $w_3$, the distance $\alpha_1$, and the distance $\alpha_2$ may differ based on the shape and/or size of the console shell 38 and/or the laundry appliance 10. The positioning of the apertures 94 and the slots 178 can be used to vertically and laterally position the edge-to-edge lid 58 to be aligned with left and right shoulders 82, 86 to provide a continuous planar surface when the edge-to-edge lid 58 is in the closed position.

Referring to FIG. 8, the rotary damper 182 may include the shaft 190, a damper 194, and a housing 198. The shaft 190 may extend from the housing 198. The shaft 190 may include opposing rounded sides 202 and opposing flat sides 206. In various examples, the opposing rounded sides 202 may be lateral sides of the shaft 190 and the opposing flat sides 206 may be top and bottom sides of the shaft 190. It will be understood that the shape of the shaft 190 (FIG. 7) may differ based on the shape and/or size of the slot 178 to securely couple the rotary damper 182 to the left and right shoulders 82, 86, respectively. An inner portion 210 of the shaft 190 may be rounded to define a cylindrical or frusto-cylindrical shape. In such examples, the shaft 190 includes recesses 214 defined by the inner portion 210 and the opposing flat sides 206 that cooperate with the shape of the slot 178.

The shaft 190 of the rotary damper 182 may be coupled to the housing 198. The housing 198 may be cylindrical or frusto-conical shape. It will be contemplated that the housing 198 may be a different shape based on the edge-to-edge lid 58 (FIG. 1). The housing 198 may have a greater width $w_6$ compared to a width $w_7$ of the shaft 190. The housing 198 may be rotatably coupled to the shaft 190 with the damper 194 therebetween. The damper 194 may be an inertia damper that operates to counter or damp the effect of inertia and/or other forces of motion. The damper 194 may act to absorb or redirect forces from the movement of the edge-to-edge lid (FIG. 1). The rotary damper 182 may dissipate the rotary motion of the edge-to-edge lid (FIG. 1) as heat in a viscous fluid or gel. It will also be contemplated that a paddle wheel or toothed gear may be used in the rotary damper 182. It may be advantageous to utilize the rotary damper 182 to allow for a slow-close edge-to-edge lid 58 (FIG. 1). It may also be advantageous to utilize the rotary damper 182 when the edge-to-edge lid 58 (FIG. 1) includes the glass panel 170 (FIG. 6) to minimize and/or prevent damage to the glass panel 170.

Figure 9:
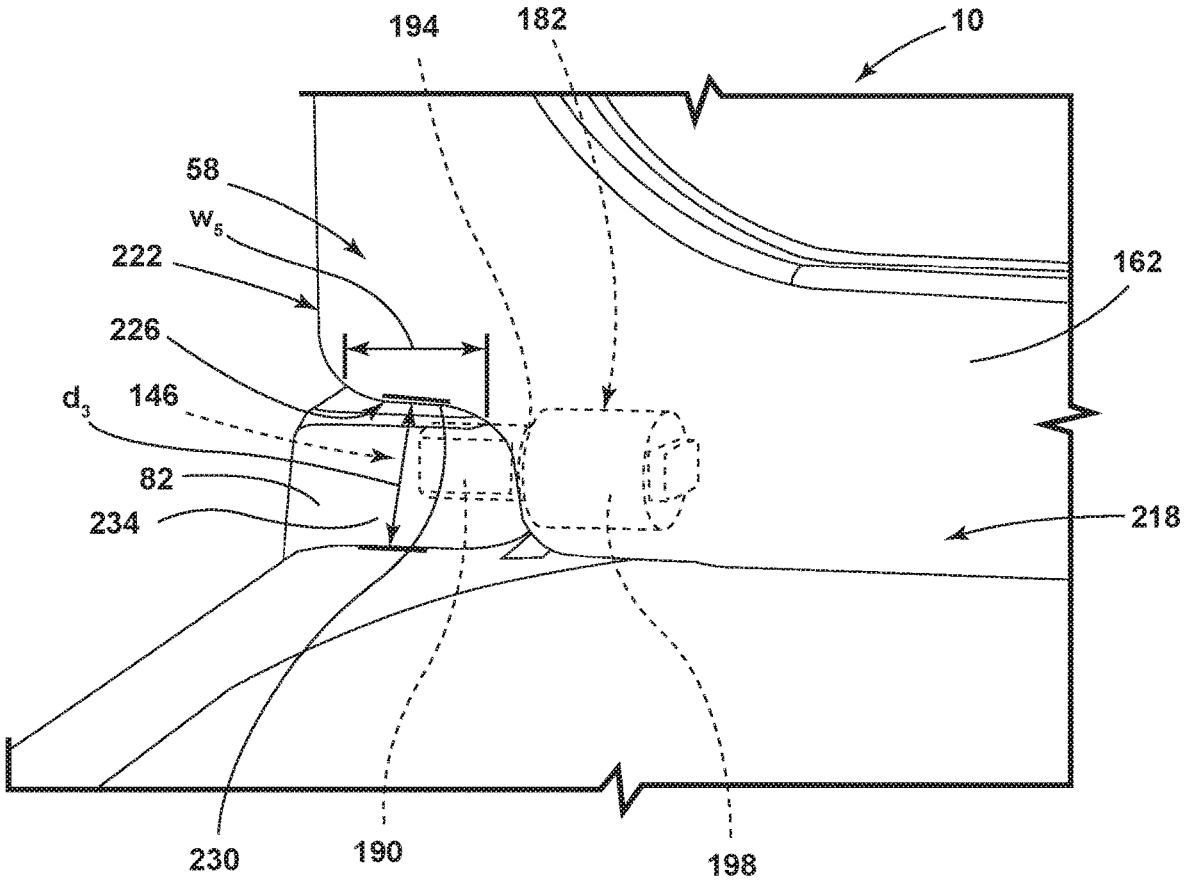
FIG. 9 is a partial side perspective view of the left shoulder with the edge-to-edge lid in the opened position, according to at least one example.

Referring to FIG. 9, the edge-to-edge lid 58 may be pivotally coupled to the left shoulder 82 via the rotary damper 182. It will be understood that the right shoulder 86 (FIG. 2) may be coupled to the rotary damper 182 in a similar manner. In other words, the edge-to-edge lid 58 may be coupled to the left and right shoulders 82, 86 via left and right rotary dampers 182, respectively. The shafts 190 of the left and right rotary dampers 182 may be coupled to the left and right shoulders 82, 86, respectively. The housings 198 of the left and right rotary dampers 182 may be positioned within the edge-to-edge lid 58. The housings 198 may also be positioned within the frame 162 of the edge-to-edge lid 58. Additionally, the rotary dampers 182, including the housings 198, may be positioned within the left and right shoulder 82, 86, respectively.

In operation, the housings 198 of the rotary damper 182 may pivot with the edge-to-edge lid 58 as it moved between the opened and closed positions. While the edge-to-edge lid 58 is in motion, the shafts 190 may be substantially stationary within the cavity 146 of the left and right shoulders 82, 86, respectively. The damper 194 may slow the speed at which the edge-to-edge lid 58 moved from the opened position to the closed position. In examples including the detent lock 174 (FIG. 6), the detent lock 174 may operate to secure the edge-to-edge lid 58 into the closed position.

In various examples, the edge-to-edge lid may be coupled to the left and right shoulders 82, 86 via at least one rotary damper 182. It is contemplated that a single rotary damper 182 may be utilized that extends along a rear portion 218 of the edge-to-edge lid 58. In such examples, the housing 198 may extend between the outer edges 222 (e.g., the left and right outer edges 72, 76 shown in FIG. 2) of the edge-to-edge lid 58 and include the shafts 190 on opposing ends of the housing 198. The shafts 190 may couple to the left and right shoulder 82, 86 in a substantially similar manner as when more than one rotary damper 182 is used.

Referring still to FIG. 9, the rear portion 218 of the edge-to-edge lid 58 may define cutouts 226 proximate the outer edges 222 of the edge-to-edge lid 58. In various examples, the cutouts 226 may be defined by left and right outer edges 72, 76 (FIG. 2) of the edge-to-edge lid 58. The cutouts 226 may be configured to correspond with and/or accommodate the left and right shoulders 82, 86, respectively. The cutouts 226, as shown in FIG. 9, may define a right angle. However, it is contemplated that the cutouts 226 may be any shape depending on the size and/or shape of the left and right shoulders 82, 86. In operation, cutout edges 230 may rotate about outward surfaces 234 of the left and right shoulders 82, 86, respectively. Use of the cutouts 226 may be advantageous to provide improved aesthetics of the edge-to-edge lid while decreasing costs of the components for coupling the edge-to-edge lid 58 to the laundry appliance 10. The left and right shoulders 82, 86 and the edge-to-edge lid 58 cooperate to form a single-continuous-looking top surface of the laundry appliance 10 when the edge-to-edge lid 58 is closed.

Referring to FIGS. 2, 6, and 9, as a non-limiting example, the edge-to-edge lid 58 may have a width $w_4$ and a depth $d_2$ that are substantially similar to the width and depth of the top panel 22 and/or the laundry appliance 10, thereby extending from the left edge 66 to the right edge 70 of the top panel 22. Accordingly, in various examples, the edge-to-edge lid 58 may have a width $w_4$ in a range of from approximately 550 mm to approximately 750 mm. The depth $d_2$ of the edge-to-edge lid 58 may be in a range of from approximately 375 mm to approximately 575 mm. Further, the cutouts 226 may have a depth $d_3$ in a range of from approximately 15 mm to approximately 50 mm, and thereby corresponding with the depth $d_1$ of the left and right shoulders 82, 86. A width $w_5$ of the cutouts 226 may be in a range of from approximately 20 mm to approximately 60 mm, and thereby correspond with the width $w_2$ of the left and right shoulders 82, 86. It will be contemplated that the width $w_4$ and the depth $d_2$ of the edge-to-edge lid 58 and the depth $d_3$ and the width $w_5$ of the cutouts 226 may differ based on the shape, size, and/or model of the console shell 38 and/or laundry appliance 10. The dimensions of the edge-to-edge lid 58 and the cutouts 226 can provide for a continuous planar surface when the edge-to-edge lid 58 is in the closed position. Use of the present disclosure may provide various advantageous. First, conventional laundry appliances utilizing waterfall and/or edge-to-edge doors require large hinges mounted under the top surface of the laundry appliance. The laundry appliance 10 of the present disclosure may utilize the left and right shoulders 82, 86 that extend from the body 42 of the console shell 38 a distance in a range of from approximately 1 inch to approximately 2 inches towards the front 54 of the laundry appliance 10 to accommodate the wire hinges 102 and/or the rotary dampers 182. Use of the wire hinges 102 and/or rotary dampers 182 may decrease the costs of parts, manufacturing, and/or production of the laundry appliance 10. Additionally, conventional laundry appliances utilize extra components to secure the door and/or edge-to-edge door to the laundry appliance. Use of the integrated console shell 38 with the left and right shoulders 82, 86 may provide for a single component for coupling the edge-to-edge lid 58 to the laundry appliance 10.

According to at least one aspect, the laundry appliance may include a cabinet and a top panel coupled to a top edge of the cabinet. The console shell may be coupled to the top panel. The console shell may define left and right shoulders extending from the console shell towards a front of the cabinet. An edge-to-edge lid may be coupled to the left and right shoulders via left and right wire hinges, respectively.

According to another aspect, the edge-to-edge lid may extend from a right edge of the cabinet to a left edge cabinet.

According to another aspect, the left and right shoulders may extend approximately 1 inch from a body of the console shell.

According to still another aspect, the left and right shoulders may each define an aperture on an interior surface for receiving the left and right wire hinges, respectively.

According to another aspect, left and right hinge stops may be positioned within an interior of the left and right shoulders, respectively.

According to yet another aspect, the left and right wire hinges may include a hook configured to cooperate with the left and right hinge stops, respectively, to define an open position of the edge-to-edge lid.

According to another aspect, the console shell may include a body and the left and right shoulders that form a single integral piece.

According to at least one aspect, a laundry appliance may include a cabinet and a top panel coupled to a top edge of the cabinet. A console shell may be coupled to the top panel. The console shell may define left and right shoulders. And edge-to-edge lid may be coupled to the left and right shoulders via left and right rotary dampers, respectively.

According to another aspect, shafts of the left and right rotary dampers may be coupled to the left and right shoulders, respectively. Housings of the left and right rotary dampers may be positioned within the edge-to-edge lid.

According to another aspect, the edge-to-edge lid may include a frame positioned about an inner panel.

According to still another aspect, the housings of the left and right rotary dampers may be positioned within the frame of the edge-to-edge.

According to yet another aspect, the left and right shoulders may extend approximately 2 inches from the console shell.

According to another aspect, the edge-to-edge lid may define left and right cutouts to accommodate the left and right shoulders, respectively.

According to another aspect, the left and right shoulders may each define a cavity for securing the shafts of the left and right rotary dampers respectively.

According to at least one aspect, a laundry appliance may include a cabinet and a console shell coupled to the cabinet.

The console shell may define first and second shoulders. An edge-to-edge lid may be pivotally coupled to the first and second shoulders.

According to another aspect, the edge-to-edge lid may be coupled to the first and second shoulders via wire hinges.

According to still another aspect, the edge-to-edge lid may be made from steel.

According to another aspect, the edge-to-edge lid may be coupled to the first and second shoulders via at least one rotary damper.

According to still another aspect, the edge-to-edge lead may include a frame and a glass panel positioned therein. Next line according to another aspect, the first and second shoulders may extend a distance in a range of from approximately 1 inch to approximately 2 inches from the console shelters a front of the cabinet.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance comprising:

a cabinet;

a top panel coupled to a top edge of the cabinet;

a console shell coupled to the top panel, wherein the console shell defines left and right shoulders extending from the console shell towards a front of the cabinet; and an edge-to-edge lid coupled to the left and right shoulders via left and right wire hinges, respectively, wherein the edge-to-edge lid defines left and right cutouts to accommodate the left and right shoulders, respectively.

2. The laundry appliance of claim 1, wherein the edge-to-edge lid extends from a right edge of the cabinet to a left edge of the cabinet.

3. The laundry appliance of claim 1, wherein the left and right shoulders extend approximately one inch from a body of the console shell.

4. The laundry appliance of claim 1, wherein the left and right shoulders each define an aperture on an interior surface for receiving the left and right wire hinges, respectively.

5. The laundry appliance of claim 1, further comprising:

left and right hinge stops positioned within an interior of the left and right shoulders, respectively.

6. The laundry appliance of claim 5, wherein the left and right wire hinges include a hook configured to cooperate with the left and right hinge stops, respectively, to define an open position of the edge-to-edge lid.

7. The laundry appliance of claim 1, wherein the console shell includes a body and the left and right shoulders that form a single integral piece.

8. The laundry appliance of claim 1, wherein the edge-to-edge lid includes a frame positioned about an inner panel.

9. A laundry appliance, comprising:

a cabinet;

a top panel coupled to a top edge of the cabinet;

a console shell coupled to the top panel, wherein the console shell defines left and right shoulders; and an edge-to-edge lid coupled to the left and right shoulders via left and right rotary dampers, respectively, wherein the edge-to-edge lid defines left and right cutouts to accommodate the left and right shoulders, respectively.

10. The laundry appliance of claim 9, wherein shafts of the left and right rotary dampers are coupled to the left and right shoulders, respectively, and housings of the left and right rotary dampers are positioned within the edge-to-edge lid.

11. The laundry appliance of claim 10, wherein the left and right shoulders each define a cavity for securing the shafts of the left and right rotary dampers, respectively.

12. The laundry appliance of claim 9, wherein the edge-to-edge lid includes a frame positioned about an inner panel.

13. The laundry appliance of claim 12, wherein housings of the left and right rotary dampers are positioned within the frame of the edge-to-edge lid.

14. The laundry appliance of claim 9, wherein the left and right shoulders extend approximately 2 inches from the console shell.

15. A laundry appliance, comprising:

a cabinet;

a console shell coupled to the cabinet, wherein the console shell defines first and second shoulders; and an edge-to-edge lid pivotally coupled to the first and second shoulders, wherein the edge-to-edge lid includes a frame and a glass panel positioned therein.

16. The laundry appliance of claim 15, wherein the edge-to-edge lid is coupled to the first and second shoulders via wire hinges.

17. The laundry appliance of claim 16, wherein the edge-to-edge lid is made from steel.

18. The laundry appliance of claim 15, wherein the edge-to-edge lid is coupled to the first and second shoulders via at least one rotary damper.

19. The laundry appliance of claim 15, wherein the first and second shoulders extend a distance in a range of from approximately 1 inch to approximately 2 inches from the console shell towards a front of the cabinet.

* * * * *